US009598788B2

(12) United States Patent
Harris et al.

(10) Patent No.: US 9,598,788 B2
(45) **Date of Patent: *Mar. 21, 2017**

(54) ELECTROPLATING APPARATUS WITH CONTACT RING DEPLATING

(71) Applicant: APPLIED Materials, Inc., Santa Clara, CA (US)

(72) Inventors: Randy A. Harris, Kalispell, MT (US); Bryan J. Puch, Kalispell, MT (US)

(73) Assignee: APPLIED Materials, Inc., Santa Clara, CA (US)

( * ) Notice: Subject to any disclaimer, the term of this patent is extended or adjusted under 35 U.S.C. 154(b) by 646 days.

This patent is subject to a terminal disclaimer.

(21) Appl. No.: 14/037,158

(22) Filed: Sep. 25, 2013

(65) Prior Publication Data

US 2014/0083862 A1 Mar. 27, 2014

Related U.S. Application Data

(60) Provisional application No. 61/706,256, filed on Sep. 27, 2012.

(51) Int. Cl.

| | |
|---|---|
| ***C25D 5/48*** | (2006.01) |
| ***C25D 17/00*** | (2006.01) |
| ***C25D 21/00*** | (2006.01) |

(52) U.S. Cl.

CPC ..... *C25D 5/48* (2013.01); *C25D 17/001* (2013.01); *C25D 17/005* (2013.01); *C25D 21/00* (2013.01)

(58) Field of Classification Search

CPC ..... C25D 17/001; C25D 17/12–17/126; C25D 5/04–5/06

See application file for complete search history.

(56) References Cited

U.S. PATENT DOCUMENTS

| | | | | |
|---|---|---|---|---|
| 6,024,856 A * | 2/2000 | Haydu | ..... | C25D 21/14 204/232 |
| 6,527,920 B1 * | 3/2003 | Mayer | ..... | C25D 21/12 204/237 |
| 6,623,609 B2 | 9/2003 | Harris et al. | | |
| 6,846,392 B1 * | 1/2005 | Stockbower | ..... | C25D 17/10 204/266 |

(Continued)

OTHER PUBLICATIONS

Taiwan Intellectual Property Office, Office Action issued in TW Patent Application No. 102135107 (Sep. 20, 2016).

*Primary Examiner* — James Lin
*Assistant Examiner* — Ho-Sung Chung
(74) *Attorney, Agent, or Firm* — Kenneth H. Ohriner; Perkins Coie LLP

(57) ABSTRACT

An electroplating apparatus has a rotor in a head, with a contact ring on the rotor. A lift/rotate actuator may move the head to position a sector of the contact ring into a deplate channel of a deplating station. Electrical current and a deplate liquid are applied directly onto the contacts of the contact ring, from a position radially inward of the contacts. Electrical current and a deplate liquid may also be separately applied onto the back side of the ring contact, from a position radially to the outside of the contact ring. A seal on the deplating station makes sliding contact with the contact ring as the contact ring rotates through the deplate channel, with the seal associated with an exhaust or vacuum opening that pulls deplating and rinse liquid through openings in the contact ring.

20 Claims, 10 Drawing Sheets

(56) References Cited

U.S. PATENT DOCUMENTS

| | | | | |
|---|---|---|---|---|
| 7,351,314 | B2 | 4/2008 | Klocke et al. | |
| 7,371,306 | B2 | 5/2008 | Davis et al. | |
| 7,585,398 | B2 | 9/2009 | Hanson et al. | |
| 8,500,968 | B2 * | 8/2013 | Woodruff | C25D 17/001 204/194 |
| 2001/0032788 | A1 * | 10/2001 | Woodruff | C25D 17/10 205/687 |
| 2002/0008037 | A1 * | 1/2002 | Wilson | C25D 17/02 205/157 |
| 2002/0053509 | A1 * | 5/2002 | Hanson | C23C 18/1632 204/198 |
| 2002/0066471 | A1 | 6/2002 | Peace et al. | |
| 2002/0083960 | A1 | 7/2002 | Wirth et al. | |
| 2004/0112738 | A1 * | 6/2004 | Thompson | H01L 21/32134 204/198 |
| 2004/0222101 | A1 * | 11/2004 | Ajmera | C25D 21/06 205/99 |
| 2005/0133067 | A1 * | 6/2005 | Bergman | B08B 3/00 134/26 |
| 2005/0145499 | A1 * | 7/2005 | Kovarsky | C25D 5/18 205/103 |
| 2006/0289302 | A1 | 12/2006 | Hanson | |
| 2012/0037495 | A1 | 2/2012 | Woodruff et al. | |

* cited by examiner

ELECTROPLATING APPARATUS WITH CONTACT RING DEPLATING

PRIORITY CLAIM

This application claims priority to U.S. Provisional Application No. 61/706,256, filed Sep. 27, 2012, and now pending.

BACKGROUND OF THE INVENTION

In manufacturing electronic products, thousands of individual microelectronic devices are generally formed on a single semiconductor wafer or another type of substrate. In a typical fabrication process, one or more thin metal layers are formed on a substrate at various stages of fabricating the microelectronic devices. The metal layers are often applied to the substrate in an electroplating chamber. A typical electroplating chamber includes a bowl or vessel for holding an electroplating solution, one or more anodes in the vessel in contact the electroplating solution, and a substrate holder having a contact ring with multiple electrical contacts that engage a seed-layer on a front surface the substrate. The electrical contacts are coupled to a power supply to apply a voltage to the seed layer. In operation, the front surface of the substrate is immersed in the electroplating solution so that the anode and the seed layer establish an electrical field that causes metal ions in the electroplating solution to plate out onto the seed layer.

As feature sizes continue to shrink, the metal seed layer used to initiate the electroplating process must also be thinner as well. As the seed layer gets thinner it becomes more important that the electrical contacts touching the seed layer are clean and dry. Liquid remaining on the contacts and touching the seed layer has the potential to etch the seed layer. An etched seed layer causes the loss of electrical contact in the etched location which results in an unacceptable electroplated wafer.

In electroplating processors where the contacts are exposed to the plating bath, metal is plated onto the seed layer, and also onto the contacts. The contacts must be frequently "de-plated" to remove the metal that plates onto them. Techniques for deplating contacts have been known and used in the past with varying degrees of success. Still, engineering challenges remain in the design of deplating features in electroplating chambers capable of plating onto ever thinner seed layers.

BRIEF STATEMENT OF THE INVENTION

An electroplating chamber de-plates, rinses and dries a ring contact. This reduces consumption of deplating liquid, and more effectively captures or confines overspray and out gassing during the de-plate, rinse and dry processes.

DETAILED DESCRIPTION

Figure 1:
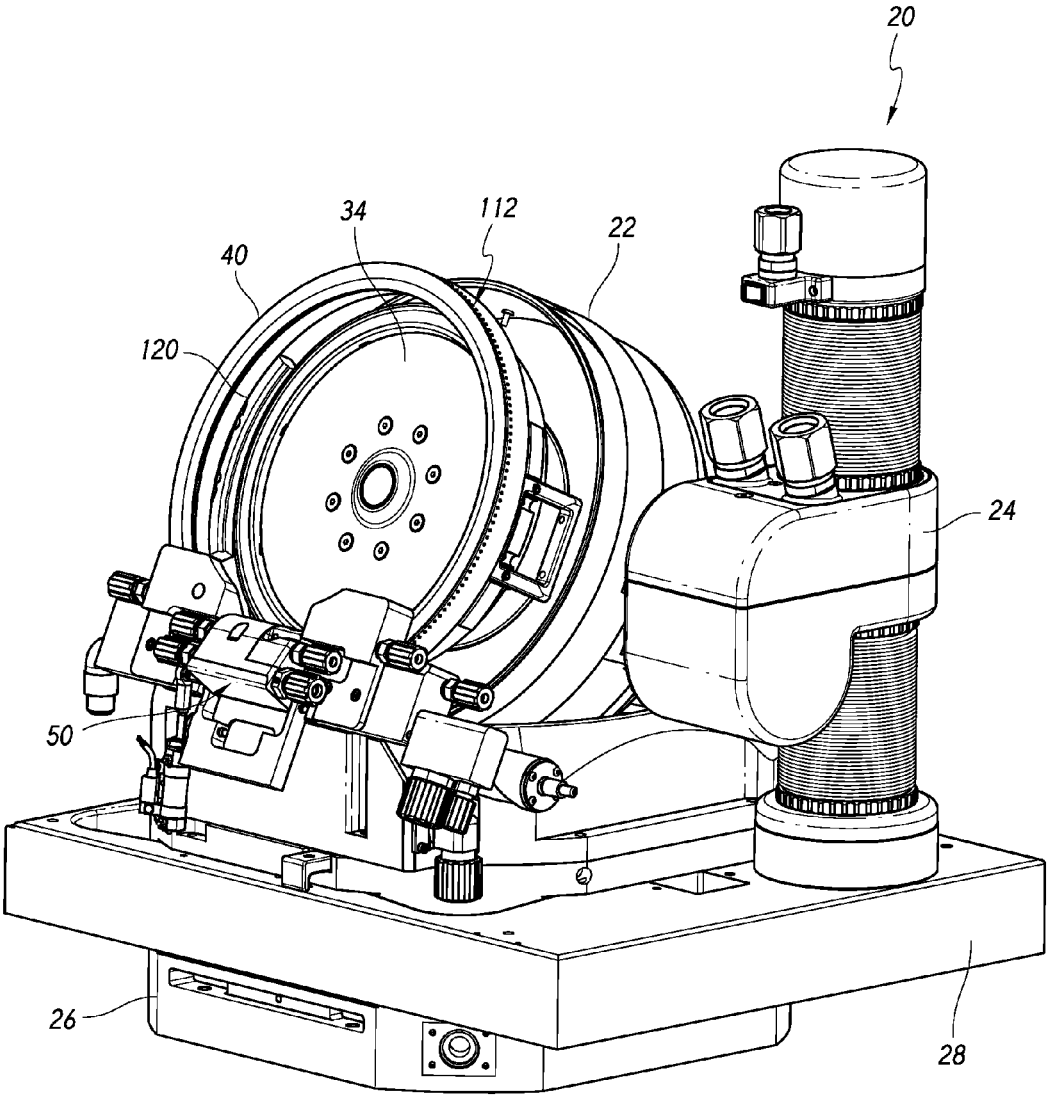
FIG. 1 is a perspective view of an electroplating chamber with the head in a de-plate position.
Figure 2:
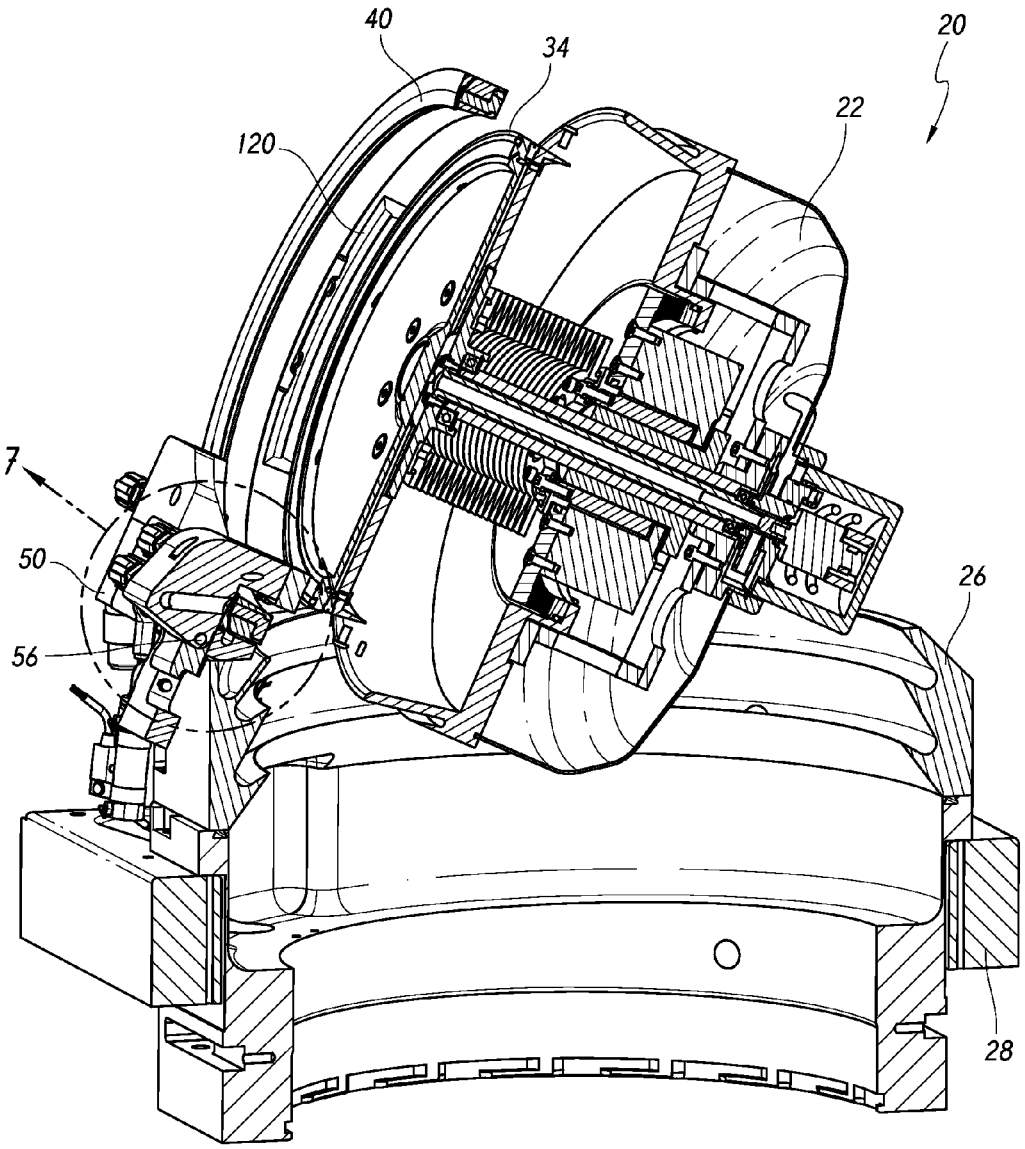
FIG. 2 is a section view of FIG. 1.

As shown in FIGS. 1 and 2, an electroplating chamber or apparatus 20 has a head 22 supported on a lift/rotate assembly 24. A rotor 34 in the head 22 holds a substrate. During electroplating, the lift/rotate assembly 24 moves the head 22 largely into engagement with a vessel 26 on a deck 28 to place the substrate into contact with electrolyte or plating liquid in the vessel 26.

Contacts on a contact ring 40 make electrical contact with a seed layer on the substrate. Electrical current flows through the plating liquid, the contacts and the seed layer, causing metal ions in the plating liquid to deposit out onto the seed layer, resulting in a plated metal layer on the seed layer.

Figure 10:
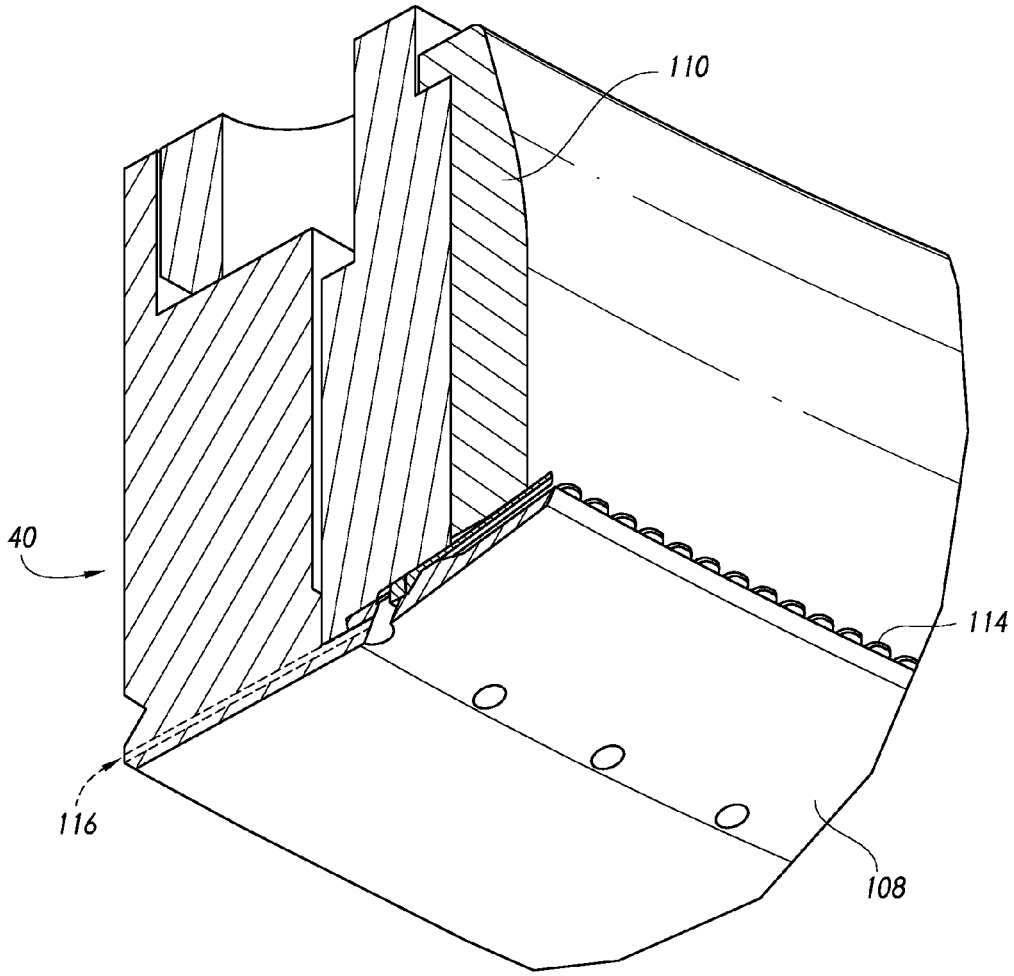
FIGS. 10 and 11 are enlarged detail views of a contact ring as may be used in the processor shown in FIGS. 1-2.
Figure 11:
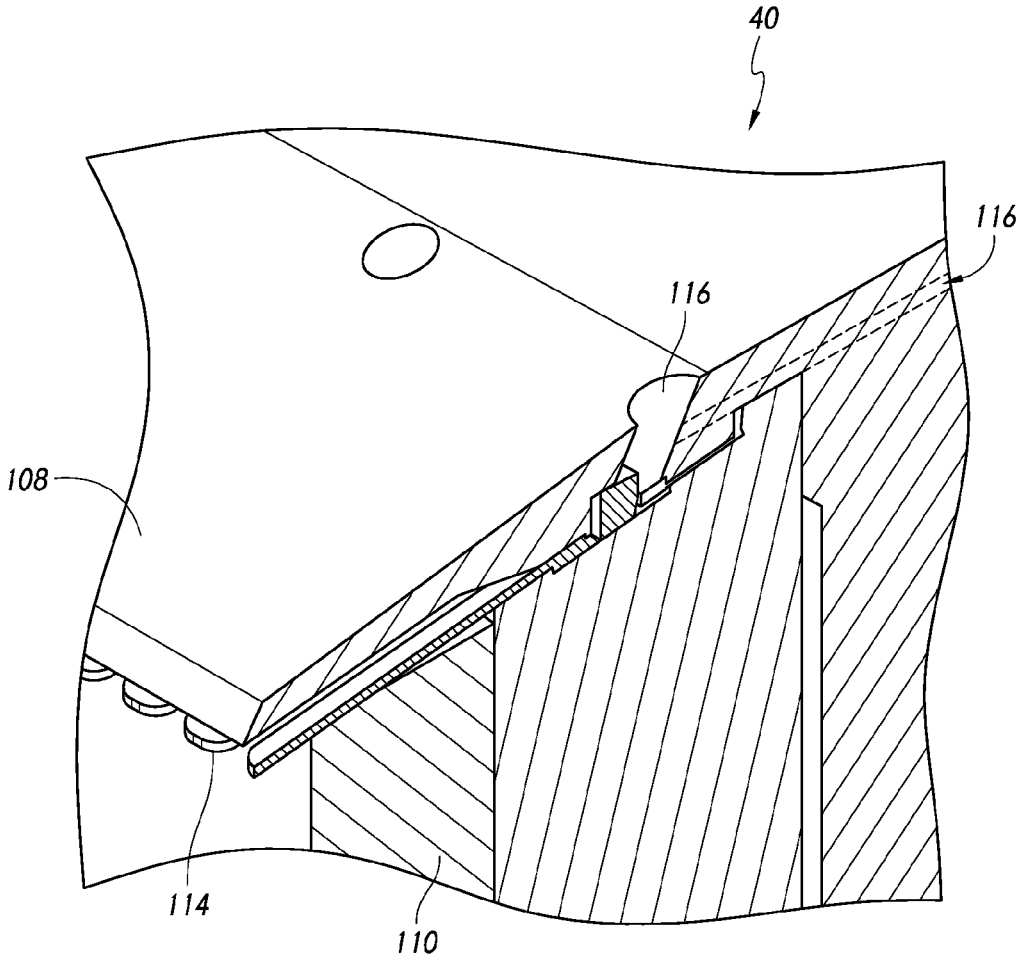

The contacts on the contact ring 40 may be deplated by positioning the contact ring 40 into a deplate station 50, as shown in FIGS. 1 and 2, and then slowly rotating the contact ring while a deplating liquid and a deplating electric current are applied to the contacts. The contacts must then be rinsed and dried to avoid inadvertently etching the seed layer of a subsequently plated substrate. As shown in FIGS. 10-11, the contact ring 40 may have inwardly projecting contacts or fingers 114, a shield 108, rinse openings or holes 116 and a lead-in ring or inner liner 110.

Figure 4:
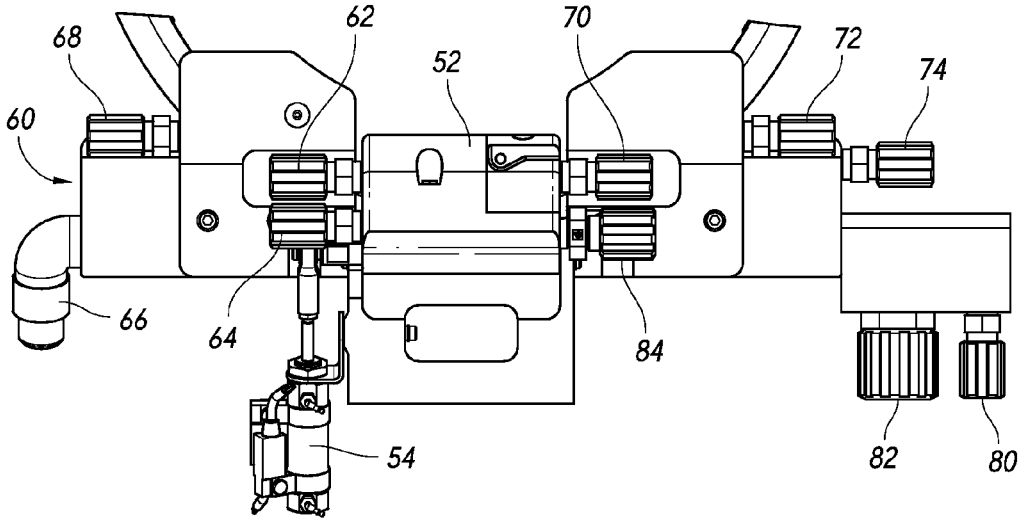
FIG. 4 is top view of the deplating station shown in FIG. 3.
Figure 5:
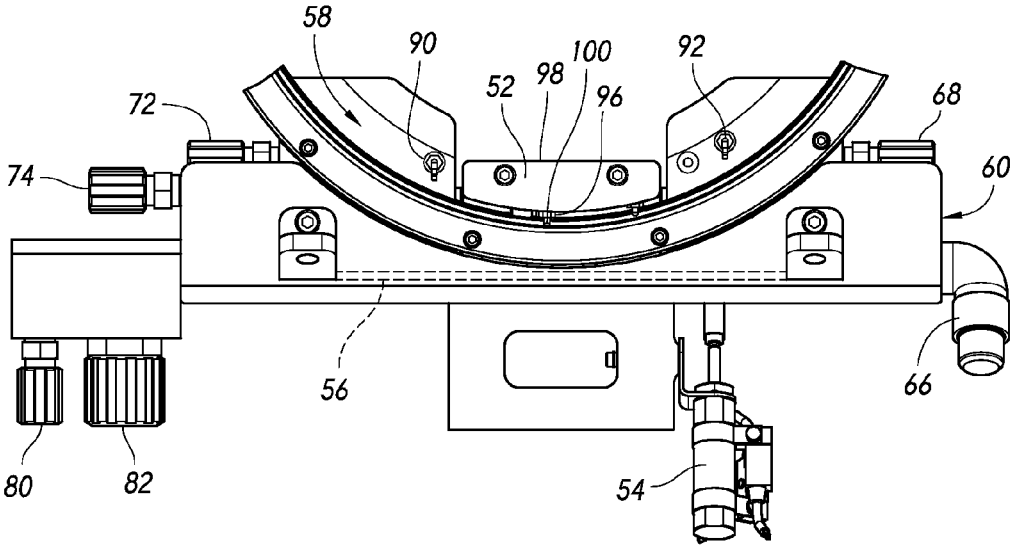
FIG. 5 is a bottom view looking up of the deplating station shown in FIGS. 4 and 5.
Figure 6:
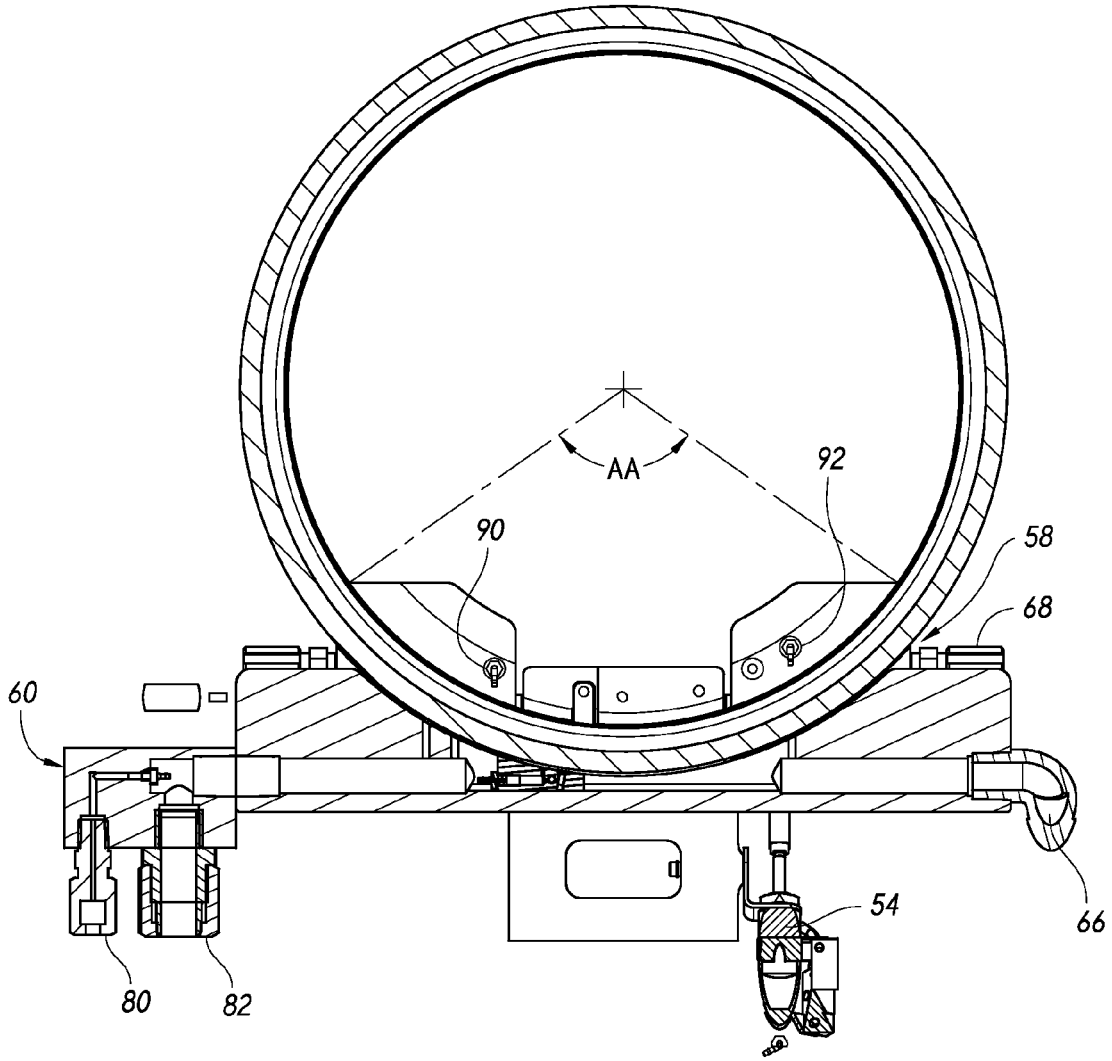
FIG. 6 is a section view of the deplating station.
Figure 7:
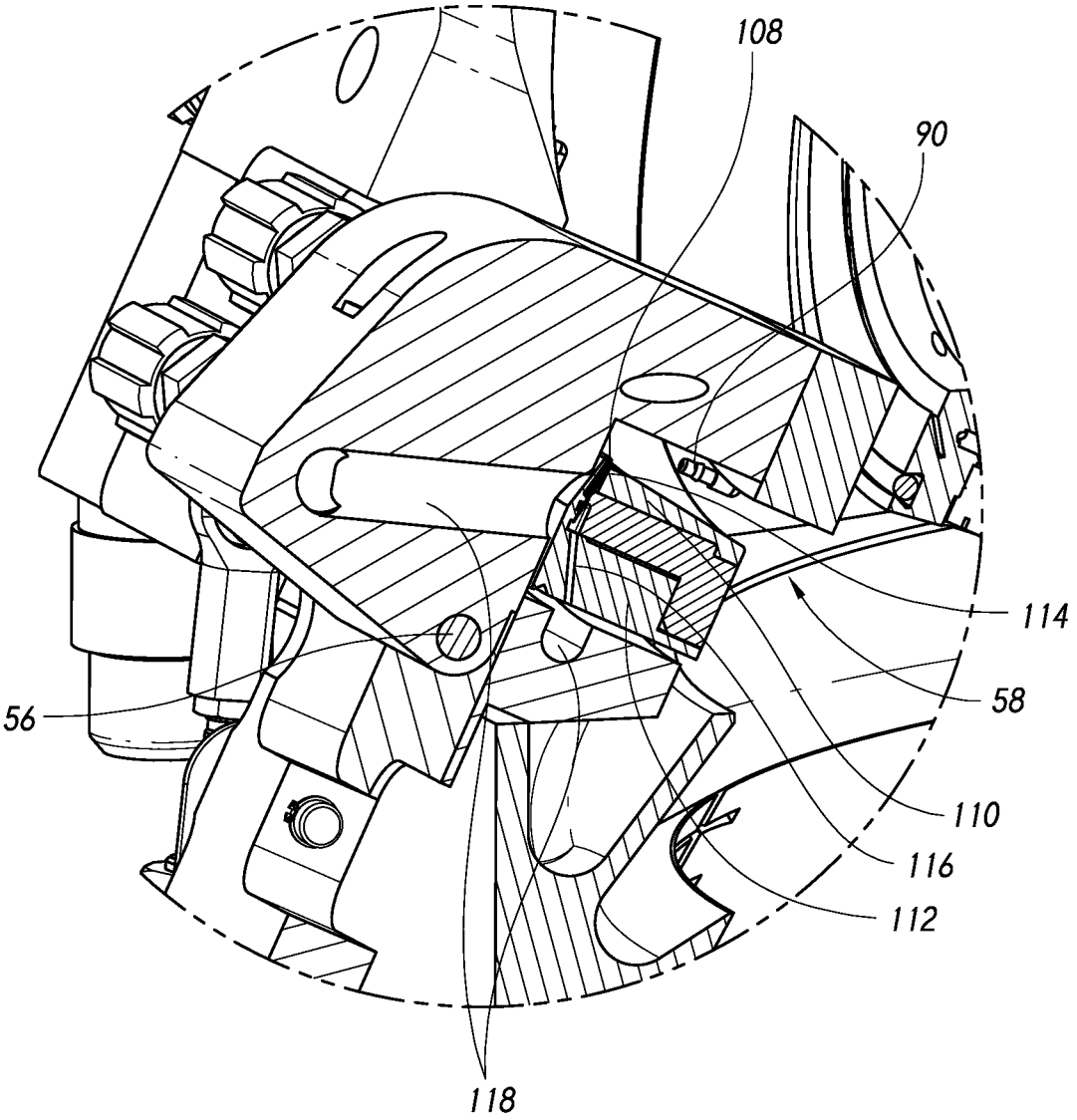
FIG. 7 is an enlarged view of features of the deplating station as shown in FIG. 2.

As shown in FIGS. 3-6, the deplate station 50 includes a deplate head 52 pivotally attached onto a deplate housing 60 via a hinge joint 56. A head actuator 54 pivots the deplate head 52 between an up or open position, for allowing the contact ring 40 to be moved into a deplate channel or slot 58 extending through the deplate station, to a down or closed position for deplating operations. Referring momentarily to FIG. 6, the deplate slot 58 subtends an arc AA of about 45 to 100 degrees and has a cross section shape generally similar to the contact ring 40.

Figure 9:
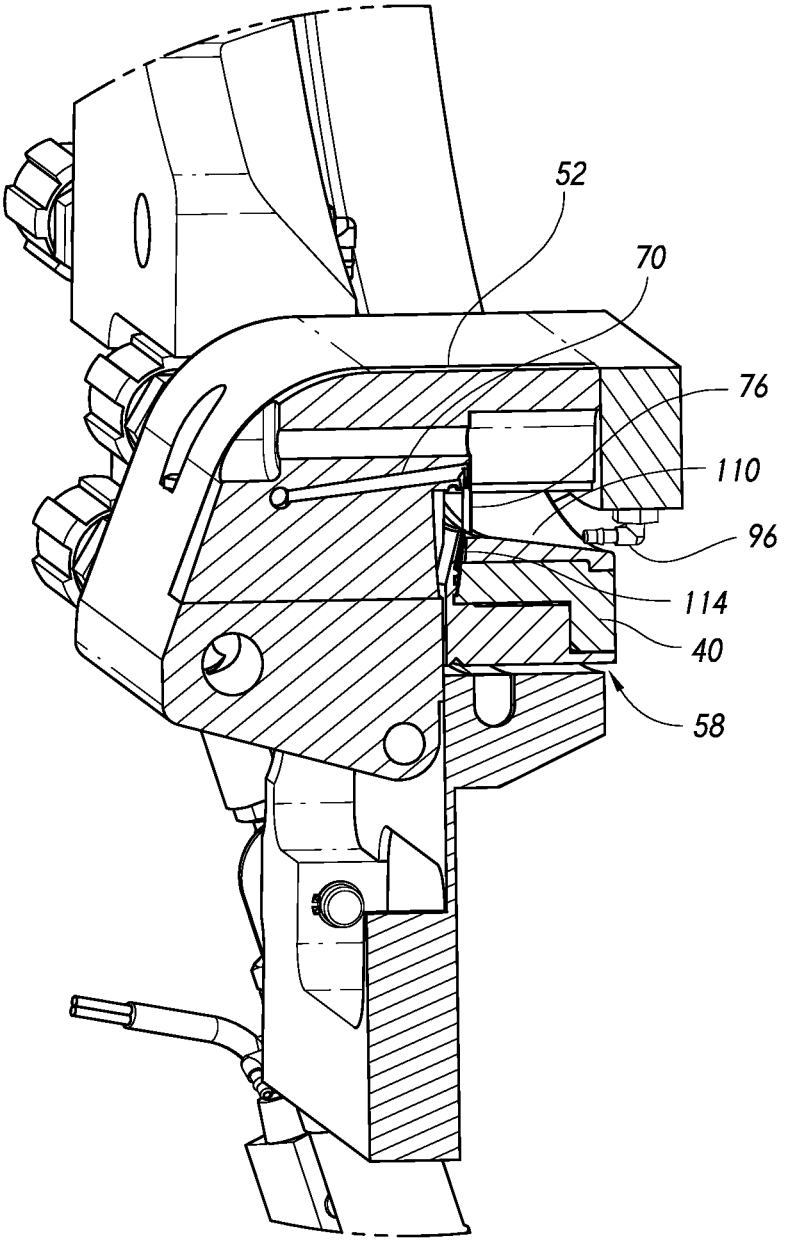
FIG. 9 is an enlarged view of features shown in FIG. 8.

Referring to FIGS. 4 and 5 the deplate head 54 has fittings or connections for a lead-in rinse line 62, a lead-in dry line 64, a contact deplate liquid lead-in line 70, and a contact exhaust/vacuum line 84. Flexible lines are used for these plumbing connections to allow the deplate head 52 to move between the open and closed positions. The lead-in lines 62 and 64 provide rinse liquid and drying gas onto the lead-in or inner liner 110. As shown in FIG. 9, a contact deplate electrode 76 is positioned at the outlet or nozzle of the contact deplate inlet 70.

The deplate housing 60 may include similar fittings or connections for ring backside deplate liquid lead-in 80, ring exhaust/vacuum 82, exterior rinse 74, contact rinse 72, contact drying gas 68, backside exhaust 82, and ring exhaust 66. A contact rinse nozzle 90 on a bottom surface of the deplate housing 60 is supplied with rinse liquid from contact rinse line 72, and is positioned to jet or spray rinse liquid radially outwardly, or outwardly at an acute angle, onto contacts on the contact ring 40. Similarly, a contact dry nozzle 92 is positioned to spray drying gas from drying gas line 64 onto the contacts.

Figure 3:
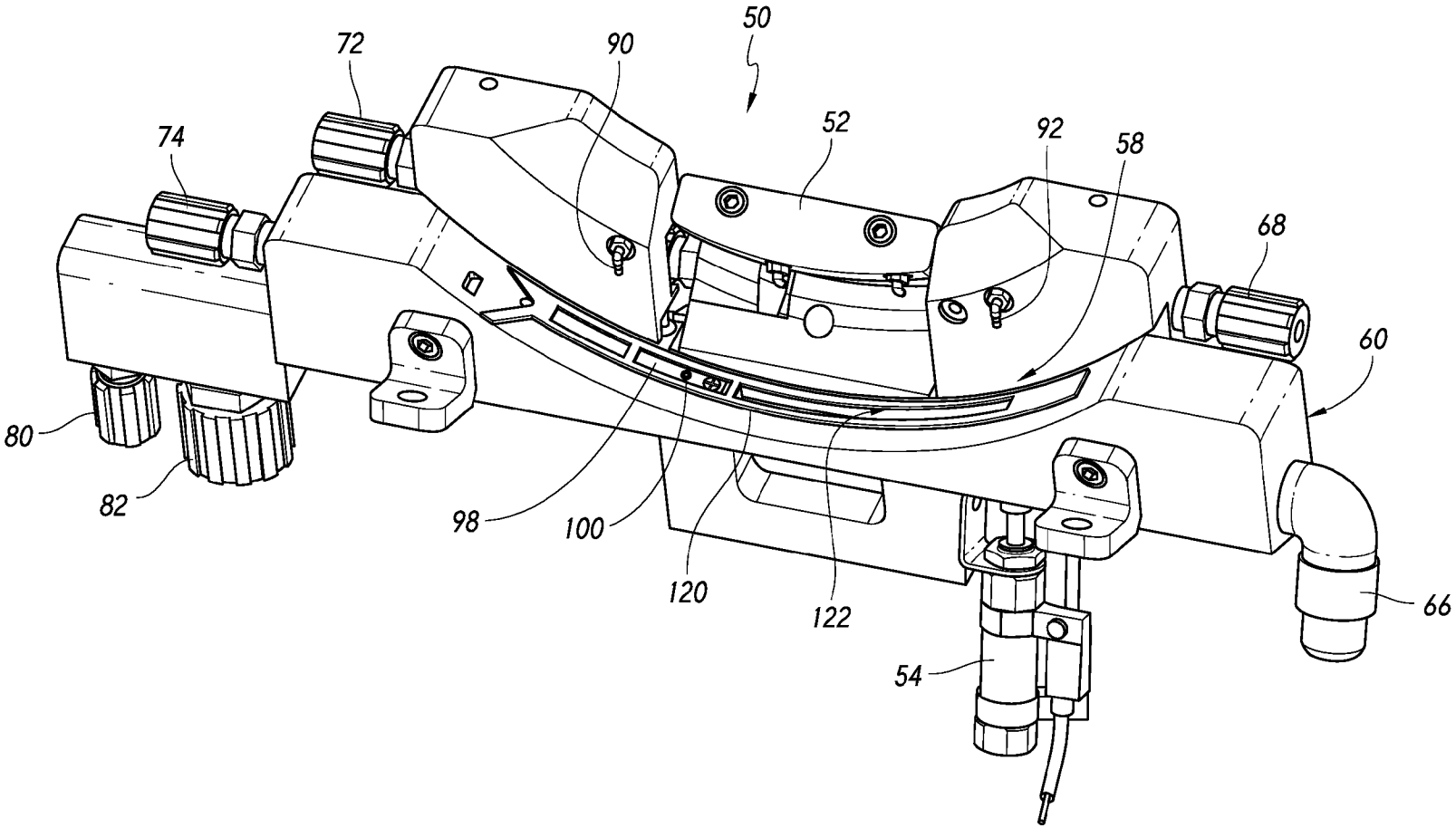
FIG. 3 is an inside perspective view of the deplating station shown in FIGS. 1 and 2.

Especially for use in plating thin seed layers, the contact ring 40 may have large number, e.g., 720 narrow contacts 114. It has been discovered that to obtain the very high level of clean required to consistently electroplate thin metal seed layers, applying deplating liquid only to the contacts themselves may not be sufficient. Accordingly, the deplate station 50 also includes elements directed to deplating the back side 112 of the contact ring 40. Turning to FIG. 3, a ring deplate electrode 98, a ring deplate liquid nozzle or outlet 100 and a ring rinse nozzle or outlet 96 are provided on the deplate housing 60 and are positioned and directed towards the back side 112 of the ring 40. A ring exhaust seal 120 may also positioned on the deplate housing 60, with an exhaust/vacuum opening 122 above the seal 120.

In use, the actuator 54 moves the deplate head 52 into the open position. The lift/rotate assembly moves the head to place the contact ring 40 into the deplate channel 58. In some processors 20, the contact ring 40 may also be extended outwardly from the head during this step. With a sector of the contact ring 40 in the deplate channel 58, the head 22 slowly rotates the rotor and the contact ring 40, continuously and sequentially moving the contacts 114 through the deplate channel 58. Deplate liquid is supplied to the contact nozzle 90. At the same time, reverse current is applied to the contact deplate electrode 76. The deplate liquid jetting or spraying out of the nozzle 90 impinges on the ring lead-in 110, passes over and between the contacts 114, through the rinse holes 116 and is exhausted or vacuumed out through the exhaust channel 118.

In addition, deplate liquid is similarly applied to the back side 112 of the contact ring 40 from the ring deplate nozzle 100 and drawn off via the exhaust opening 122, while reverse or deplating current is applied to the ring deplate electrode 98. The exhaust seal 122 makes sliding resilient contact with the back side of the contact ring. The exhaust opening 122 consequently is able to positively draw or pull liquid through the openings in the contact ring 40. Accordingly, even though the openings in the contact ring may be very small, typically in the range of 0.02 to 0.1 mm, capillary and other forces are overcome and the liquid is caused to effectively flow through the openings.

Depending on factors such and the chemical make up of plating bath, the seed layer thickness, and others, the contact ring 40 may be deplated in a single rotation, although a second or more deplate rotations may be used if necessary. After the deplate rotation, rinse liquid is applied to the contacts 114 and the back side 112 of the contact ring 40, in the same way as the deplate liquid, although no electrical current need by applied to the deplate electrodes 76 and 98.

The rinse liquid is advantageously supplied through the same channels in the deplate station 50 as used for the deplate liquid. Alternatively, separate rinse liquid channels may be used. The rinse step typically is carried out over one or two rotations of the contact ring 40, although additional rinse rotations may be used.

The contacts 114 are then dried via a spray or jet of a drying gas directed at the contacts from the contact dry nozzle 92. The back side of the contact ring 40 is simultaneously dried by airflow movement drawn into the seal exhaust opening 122. The drying gas may be clean dry air, or another gas. The drying gas may optionally be applied from the same nozzles and openings as used to apply the deplate liquid, and/or the rinse liquid. With this option, dripping can be largely avoided because the drying gas purges the liquid out from the supply lines and nozzles or openings. Alternatively, the drying gas may be applied from separate lines and nozzles.

As shown in FIGS. 1 and 2, the electroplating ring contact maintenance or deplate station 50 may be a module positioned outside and immediately adjacent to an electroplating chamber 20. The maintenance station 50 may provide four functions. First is the de-plate function. This may use one or more conductive nozzles that deliver deplate fluid and electric current to the contact fingers for deplating. Second, one or more rinse nozzles are used for rinsing the wafer lead in and contacts. Third, one or more gas delivery nozzles are used for drying the wafer lead in and contacts. Fourth, exhaust or vacuum is used to control dispersal of, and remove the byproducts from the de-plate, rinse and dry steps. Preventing these by-products (spray and vapors) from escaping out of the station 50 reduces contamination risks.

The ring maintenance station pivots over the contact ring 40 after the contact ring 40 is moved into the deplate position shown in FIG. 2. The maintenance station 50 may be mounted on a compliant base. This allows the station to follow the contact ring in close proximity or contact to allow proper nozzle placement and provide effective exhausting. The contact ring itself may also have features that assist during insure the de-plate, rinse and dry steps. Specifically, the contact ring 40 may be a wet ring contact having a shield 108 overlying a ring of contacts 114. The contact ring 40 and the shield 108 may be designed to create a flow path that causes the de-plate, rinse and drying media to flow around the contacts 114, through the ring and out through the holes 116 in the contact ring 40. The face of the shield 108 interfaces with the low pressure exhaust which helps pull the liquid and gasses through the ring and into the exhaust channel 118. This interface can be established by locating the shield 108 close to the exhaust channel 118 and via use of a compliant seal 120 between them.

Figure 8:
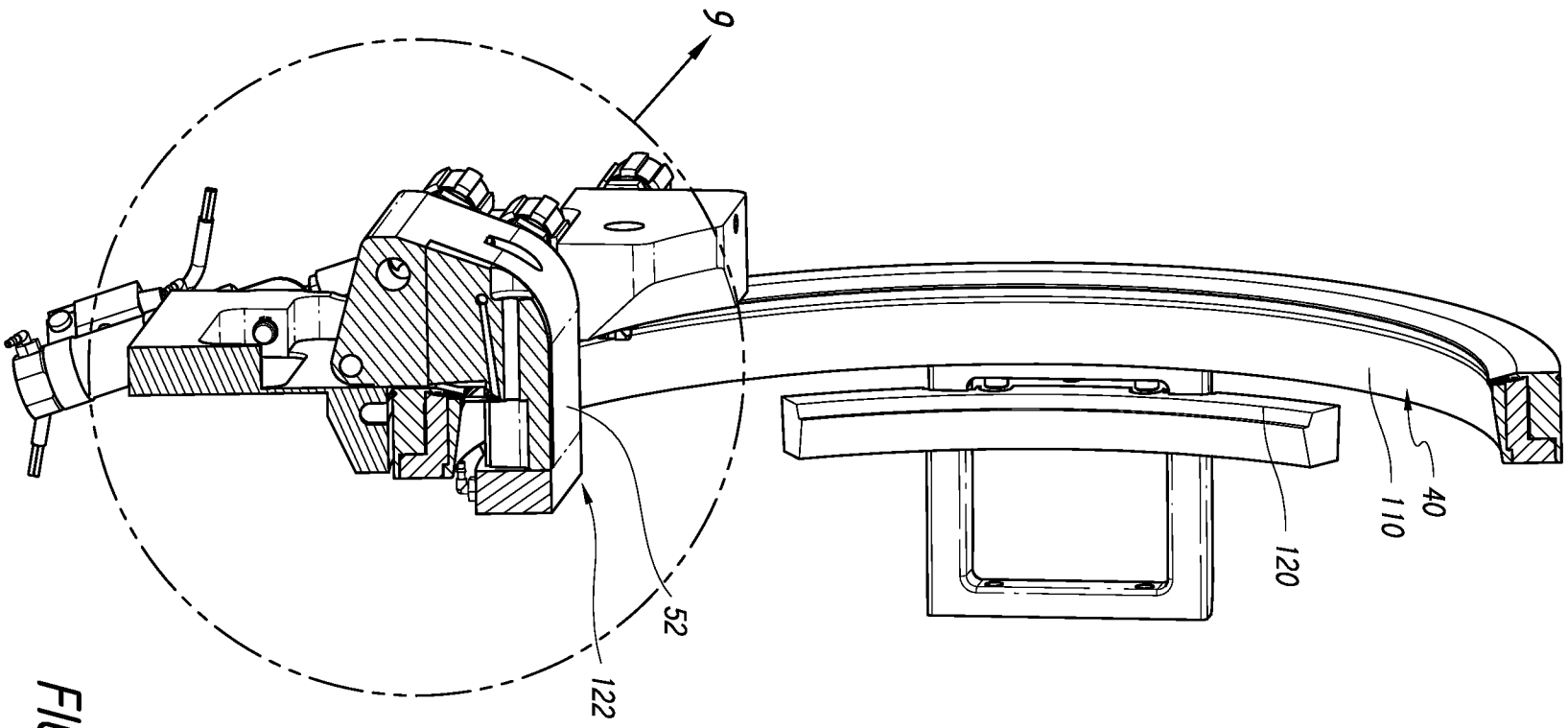
FIG. 8 is a section view of the deplating station and contact ring.

As shown in FIGS. 1, 2 and 8, the contact ring 40 may include two or more shelves 120 used to temporarily receive or hold a wafer placed into the processor 20 by a load/unload robot. With the head 22 inverted, the robot may move a wafer into the contact ring 40 and then lower the wafer down so that the wafer rests on the shelves 120. The robot then withdraws. The backing plate then moves up lifting the wafer up off of the shelves and moving the wafer up into secure contact with the fingers or electrical contacts 114 on the contact ring. To better contamination, the ring maintenance station may include one or more additional liquid or gas nozzles 122 positioned to clean off the shelves 120, as shown in FIG. 8. While the other nozzles or outlets described above are directed at the contact ring itself, the nozzles 122 are directed at the shelves. Typically the nozzles 122 may use a spray of gas or air to move any accumulated liquid off of the shelves. In the example shown, two equally spaced apart arcuate shelves 120 are used, each subtending an arc of about 45 degrees, and a single shelf nozzle 122 is used. Of course, varying numbers and other types of shelves and shelf nozzles may be equivalently used.

With the design described, de-plate, rinse and dry steps may be achieved with substantially less fluid consumption compared to existing designs. Another advantage is that only relatively small volumes of liquid pass through the ring. This provides for fast fluid exchange as well as a reduced fluid consumption, and with rapid drying. Since deplating occurs away from the plating bath, chemicals or gasses may be used without contaminating the process bath. In use, the maintenance station 50 also largely encloses the contact ring 40. This helps contain particles and spatter that result from the deplate, rinse and dry steps. The station may be efficient enough that a deplate, rinse and dry can each be accomplished in one rotation.

The invention claimed is:

1. Electroplating apparatus comprising:

a vessel for holding an electroplating solution;

a head including a rotor having a contact ring and a head motor for rotating the rotor;

a lift/rotate actuator attached to the head;

a deplate station having a deplate channel adapted to receive a sector of the contact ring;

a deplate head pivotally attached to a deplate housing of the deplate station;

with the lift/rotate actuator movable to engage the head with the vessel during plating operations, and to position a sector of the contact ring at least partially into the deplate channel;

with the deplate station having a housing fixed in place at an upper rim of the vessel, and positioned to the outside of the vessel to avoid interfering with engagement of the head with the vessel;

a first deplate electrode and a first deplate fluid nozzle on a first side of the deplate channel; and a second deplate electrode and a second deplate fluid nozzle on a second side of the deplate channel.

2. The apparatus of claim 1 further including a seal on the deplate station positioned to make sliding contact with the contact ring, as the contact ring rotates through the deplate channel.

3. The apparatus of claim 2 further including a vacuum exhaust opening in the deplate station adjacent to the seal.

4. The apparatus of claim 1 further comprising at least 360 individual spaced apart contacts on the contact ring.

5. The apparatus of claim 1 with the deplate channel forming an arcuate slot subtending an arc of 45 to 100 degrees.

6. The apparatus of claim 1 further including a deplate head actuator attached to the deplate head for pivoting the deplate head relative to the deplate housing.

7. Electroplating apparatus comprising:

a vessel for holding an electroplating solution;

a rotor having a contact ring;

a deplate head having a deplate channel;

a deplate head actuator attached to the deplate head for moving the deplate head to a first position and to a second position;

a lift/rotate actuator for moving the rotor to position the contact ring in the vessel to electroplate a substrate, and for moving the rotor to position a sector of the contact ring at least partially into the deplate channel;

with the deplate head having at least one deplate electrode and at least one deplate fluid nozzle for deplating contacts on the contact ring; and with the deplate head pivotal from the first position to the second position via the deplate head actuator, and wherein the first position is closer to the vessel than the second position.

8. The apparatus of claim 7 where the deplate channel is facing to one side when the deplate head is in the second position.

9. The apparatus of claim 7 with the deplate head having a first deplate electrode and a first deplate fluid nozzle on a first side of the deplate channel; and a second deplate electrode and a second deplate fluid nozzle on a second side of the deplate channel.

10. The apparatus of claim 7 further including two or more wafer shelves on the contact ring, and at least one shelf nozzle in the deplate head for spraying a gas onto the wafer shelves as the contact ring is rotated through the deplate channel.

11. The apparatus of claim 7 with the deplate head pivotally attached to a deplate housing of a deplate station having a deplate channel adapted to receive a sector of the contact ring, with the deplate housing fixed in place at an upper rim of the vessel, and positioned to the outside of the vessel.

12. The apparatus of claim 11 further including a seal on the deplate station positioned to make sliding contact with the contact ring, as the contact ring rotates through the deplate channel.

13. The apparatus of claim 12 further including a vacuum exhaust opening in the deplate station adjacent to the seal, and at least 360 individual spaced apart contacts on the contact ring.

14. The apparatus of claim 13 with the deplate channel forming an arcuate slot subtending an arc of 45 to 100 degrees.

15. Electroplating apparatus comprising:

a vessel for holding an electroplating solution;

a rotor having a contact ring;

a deplate head having a deplate channel;

a deplate head actuator attached to the deplate head for pivoting the deplate head relative to the vessel to a first position and to a second position;

a lift/rotate actuator for moving the rotor to position the contact ring in the vessel to electroplate a substrate, and for moving the rotor to position a sector of the contact ring at least partially into the deplate channel;

with the deplate head having at least one deplate electrode and at least one deplate fluid nozzle for deplating contacts on the contact ring.

16. The apparatus of claim 15 with the first position closer to the vessel than the second position.

17. The apparatus of claim 15 with the deplate head pivotally attached to a deplate housing of a deplate station having a deplate channel adapted to receive a sector of the contact ring, with the deplate housing fixed in place at an upper rim of the vessel, and positioned to the outside of the vessel.

18. The apparatus of claim 17 further including a seal on the deplate station positioned to make sliding contact with the contact ring, as the contact ring rotates through the deplate channel.

19. The apparatus of claim 18 further including a vacuum exhaust opening in the deplate station adjacent to the seal, at least 360 individual spaced apart contacts on the contact ring.

20. The apparatus of claim 19 with the deplate channel forming an arcuate slot subtending an arc of 45 to 100 degrees.

* * * * *